US005816015A

United States Patent [19]

Kirst

[11] Patent Number: 5,816,015

[45] Date of Patent: Oct. 6, 1998

[54] WOODEN BEAM AND PROCESS FOR ITS MANUFACTURE

[76] Inventor: Ralph Kirst, Hans-Wilhelm-Kirst-Strasse 1-4, D-56843 Irmenach, Germany

[21] Appl. No.: 831,952

[22] Filed: Apr. 2, 1997

[30] Foreign Application Priority Data

Apr. 2, 1996 [DE] Germany ..... 196 13 237.1

[51] Int. Cl.[6] ..... E04S 1/00; B27F 1/00

[52] U.S. Cl. ..... 52/745.19; 52/574; 52/731.7; 144/346; 144/355; 144/378; 156/264; 156/304.1; 428/58; 428/114; 428/105

[58] Field of Search ..... 144/3.1, 39, 345, 144/346, 355, 367, 369, 376, 377, 378; 52/574, 730.1, 730.6, 730.7, 731.7, 745.19; 156/159, 250, 260, 264, 304.1, 304.5; 428/80, 105, 106, 114, 58, 98, 107

[56] References Cited

U.S. PATENT DOCUMENTS 781,376 1/1905 Sorenson ..... 144/346
3,903,943 9/1975 Hasenwinkle ..... 144/367
3,961,654 6/1976 Hasenwinkle ..... 144/350
3,989,078 11/1976 Hasenwinkle ..... 144/350

FOREIGN PATENT DOCUMENTS 210303 8/1989 Japan ..... 144/346

*Primary Examiner*—W. Donald Bray
*Attorney, Agent, or Firm*—Sixbey, Friedman, Leedom & Ferguson; David S. Safran

[57] ABSTRACT

A beam is composed of a tree trunk which has been star-mortised into right triangular sections which are joined together in pairs to produce rectanguloid laminae that are, in turn, glued together to form a beam in which growth rings of the tree trunk are oriented vertically and in the longitudinal direction of the beam. Due to the resulting more favorable growth ring position, the beam according to the invention can be much more highly statically loaded than a conventional beam, and moreover, can be produced at much lower costs than known glued wood truss beams formed of solid, one-piece rectanguloid tree trunk sections.

6 Claims, 5 Drawing Sheets

WOODEN BEAM AND PROCESS FOR ITS MANUFACTURE

BACKGROUND OF THE INVENTION

1. Field of the Invention

The invention relates to a wooden beam and a process for its manufacture.

2. Description of Related Art

Conventional glued wooden trusses have been produced for decades, for example, in the form of beams, and have been used in wood construction. They are composed of so-called laminae which are glued together, and compared to conventional solid wood they have three major advantages: first, they can be produced in any length and dimension, lengths up to roughly 40 m being generally common today; second, due to prior drying of the individual laminae, they are almost free of cracking and warping; and third, due to their structure and glued joints, they can be loaded 10% higher.

However, one disadvantage of the laminate beams is that, due to the complex process necessary for production, as compared to solid wood, it is much more expensive. In addition, an enormous loss of material from the round timber to the finished beam must be tolerated, thus increasing the cubic meter price of the beam which ultimately becomes a multiple of that of the solid wood beam.

Another problem in the manufacture of glued laminated wood as a base product is the choice of the individual laminae. Due to the natural faults in its structure (knots, cracks, twists, reactive wood, etc.), wood cannot always be uniformly loaded; this necessitates extremely careful prior selection. Depending on the quality of the initial material, therefore, here as well, a considerable loss can again be recorded if the required quality of the finished product is to be guaranteed.

One decisive point here is the so-called growth ring position. There are vertical and horizontal growth rings, any conceivable intermediate angle also being possible. The higher the percentage of vertical growth rings, the higher the quality of the wood since, on the one hand, the load capacity is greater, and on the other, the so-called swell/shrink behavior of the lamina is more favorable. Wood swells or shrinks radially when the humidity changes only roughly half as much as tangentially; this leads to the wood warping as it dries.

SUMMARY OF THE INVENTION

A primary object of the invention is, thus, to make available a higher quality beam which does not have the aforementioned defects known from the prior art.

This object is achieved by a beam which is composed of a tree trunk which has been star-mortised into right triangular sections which are joined in pairs to produce rectanguloid laminae that are glued together to form a beam in which growth rings of the tree trunk are oriented vertically and in the longitudinal direction of the beam. Due to its more favorable growth ring position, the beam can be much more highly statically loaded than a conventional beam. The beam according to the invention can, moreover, be produced at much lower costs than the known glued wood truss beam.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENT

Figure 1:
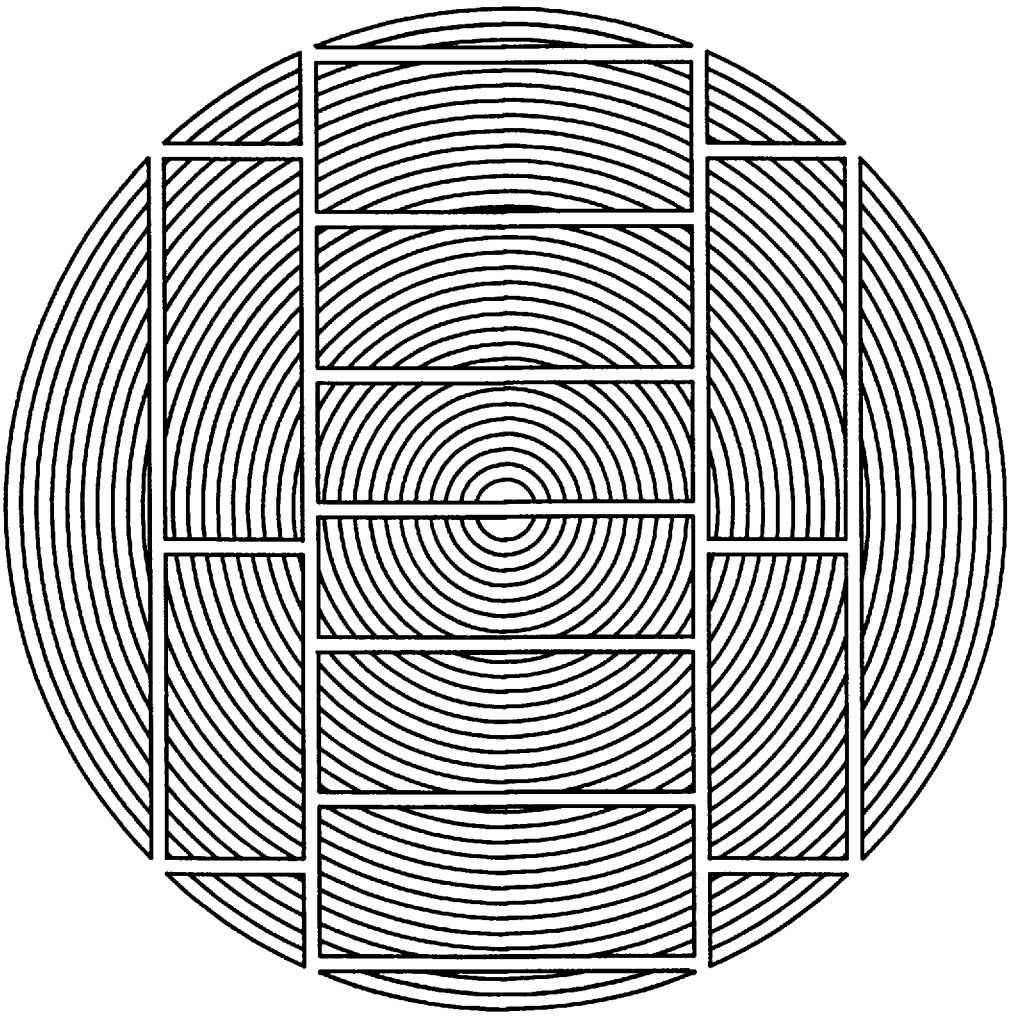
FIG. 1 (PRIOR ART)
FIG. 1 schematically shows a conventional mortise process for producing rectangular laminae.
Figure 2:
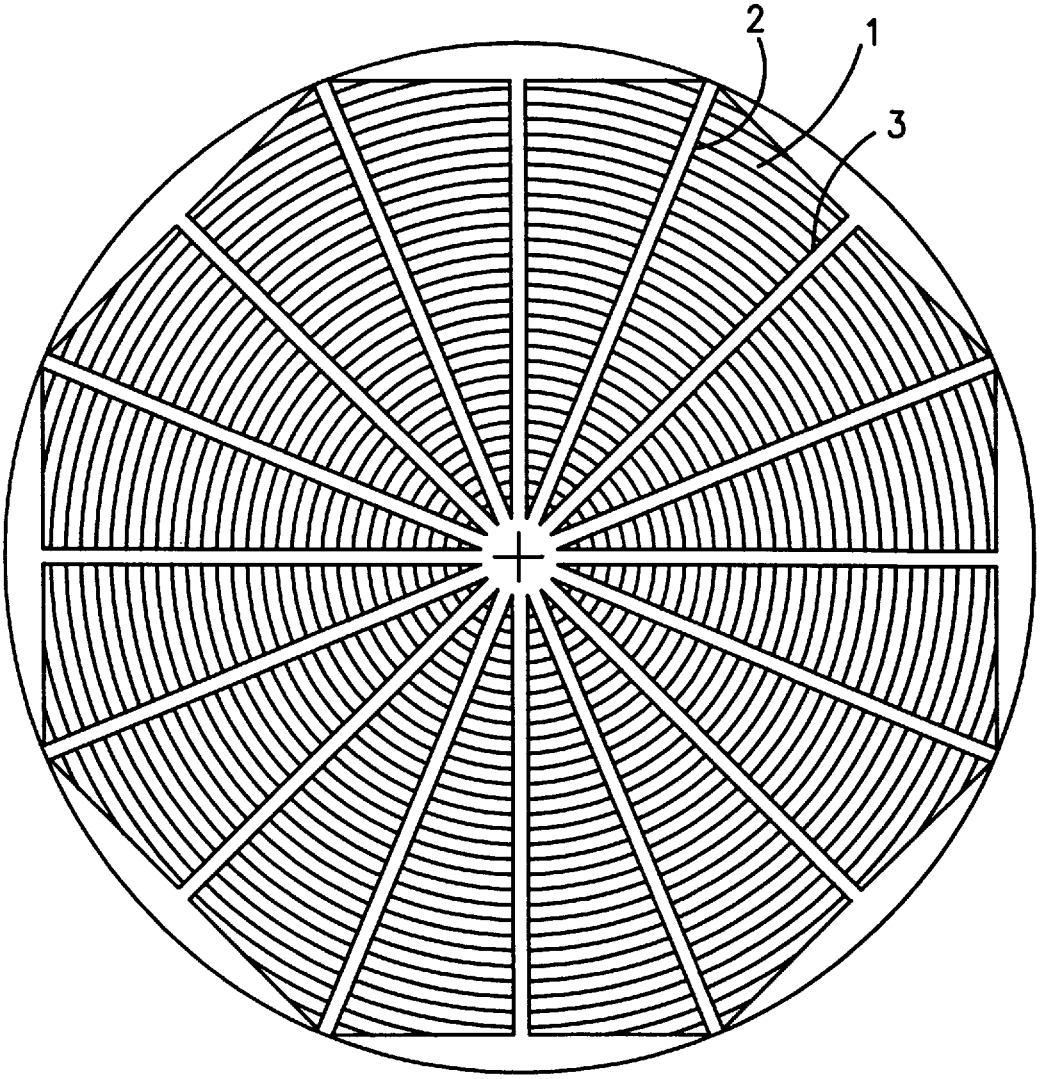
FIG. 2 schematically shows a star mortise process for producing triangular sections for producing a beam according to the invention.
Figure 4A:
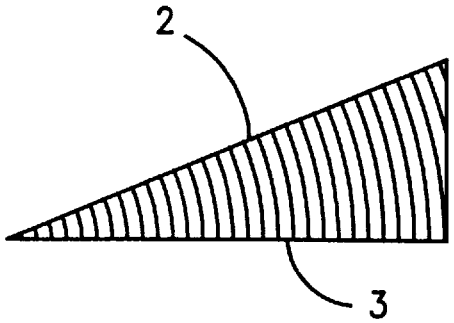
FIGS. 4A and 4B schematically show a beam according to the invention composed of triangular laminae.

The mortise process used to produce triangular laminae in accordance with the present invention differs from the process for producing the conventional laminae in that rectangular cross sections (FIG. 1) are not produced, and instead, for example and preferably, an octagon is milled from a round trunk using a profile cutter (FIG. 2), after which right triangular, radial tree trunk sections 1 (FIG. 4A) are mortised using a which right triangular, radial tree trunk sections 1 (FIG. 4A) are mortised using a so-called star mortise. In this way, sixteen triangular sections 1 with a right angle cross section are produced with longitudinal sides which are ⅔ the radial.

One advantage of this process is that no changes need be made on the mortise machine since the round timber used, regardless of its diameter, is always mortised with the same angle. The triangular sections produced then differ only in their width or height. Therefore, in production, a system can be used which, first of all, does not require expensive control, and secondly, does not require set-up times, aside from resharpening the saws.

The second advantage of this process is the much higher yield of sawn timber. Thus, in a conventional mortise (FIG. 1), the yield of the primary product is in the range from 45–50%, plus 10–15% side goods. In a star mortise (FIG. 2), on the other hand, the yield is up to 73%; at the same time, the sawn timber is available entirely as the primary product. The average yield in the star mortise process is thus roughly 25% higher than in a conventional mortise.

Figure 5:
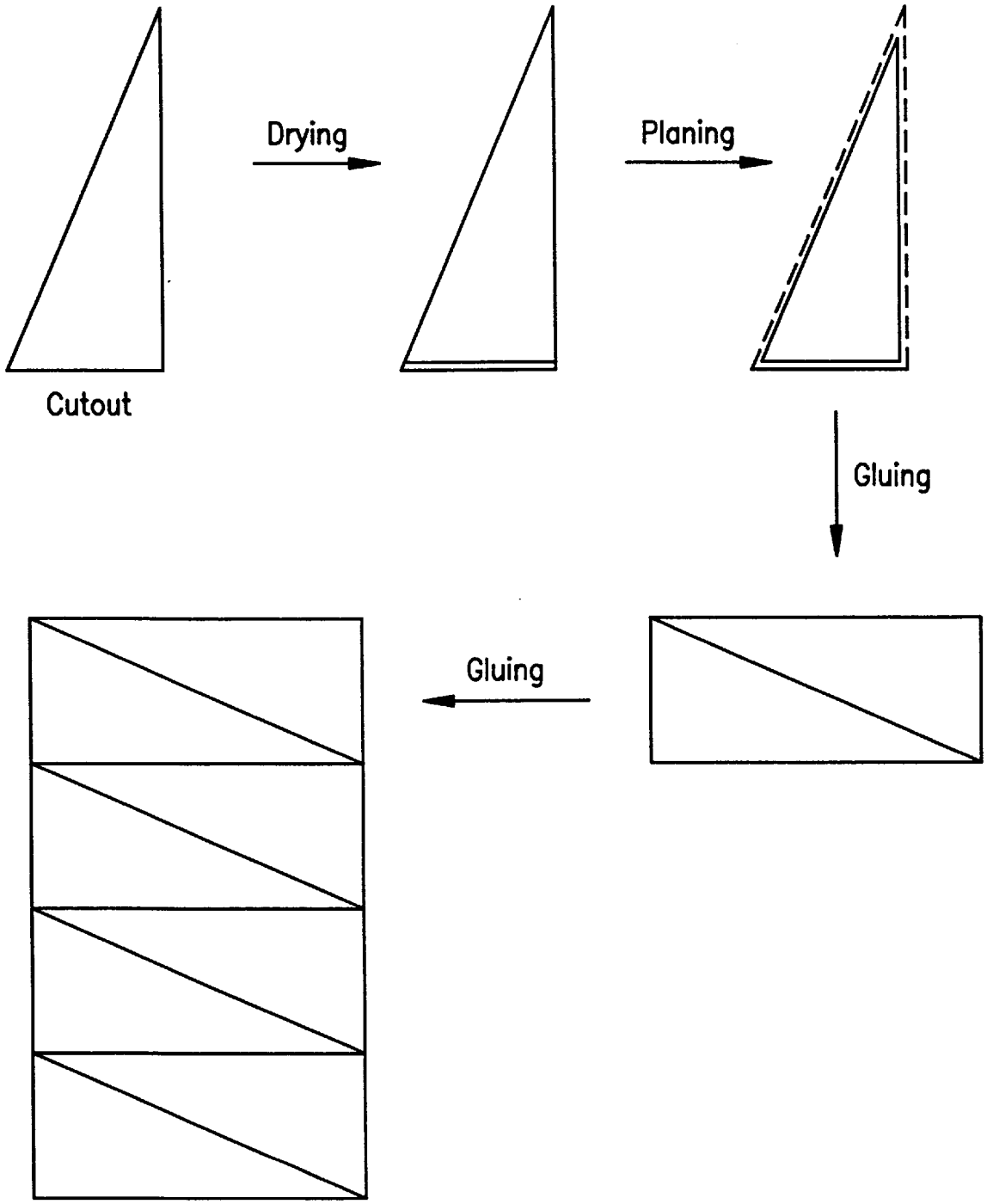
FIG. 5 is a flow diagram depicting the process for production of the beam according to the invention.

Before gluing individual sections 1, they must be dried and planed (FIG. 5); this means an additional loss of 30–35% in conventional laminae since, due to the aforementioned warping of the wood during drying, a very large overmeasure of the raw laminae must be assumed to obtain a full-size lamina after the dressing and planing process. These losses diminish in triangular laminae due to the more favorable swell/shrink behavior to 15–25%, therefore by roughly half.

Overall, as a result of the star mortise process, the material losses from round timber to glued laminated wood are no longer 60–70%, as before, but only 40–60%. While a cubic meter of conventional finished laminae engenders costs of 600 to 650 DM ($372 to $403.00), star laminae can be produced for 400 to 450 DM ($248 to $279), therefore, roughly two-thirds of the previous costs.

In the production of a beam according to the invention (FIG. 5), mortised triangular sections 1 are glued together after drying and planing. In doing so, first, two triangular sections 1 at a time are joined into a rectanguloid lamina 4 by being glued obliquely to one another. Depending on the dimensioning of the triangular sections 1 used, correspondingly dimensioned rectanguloid laminae 4 are obtained. Afterwards, the rectanguloid laminae 4 are glued to one another to form a beam of any length and/or width and/or height.

Figure 3:
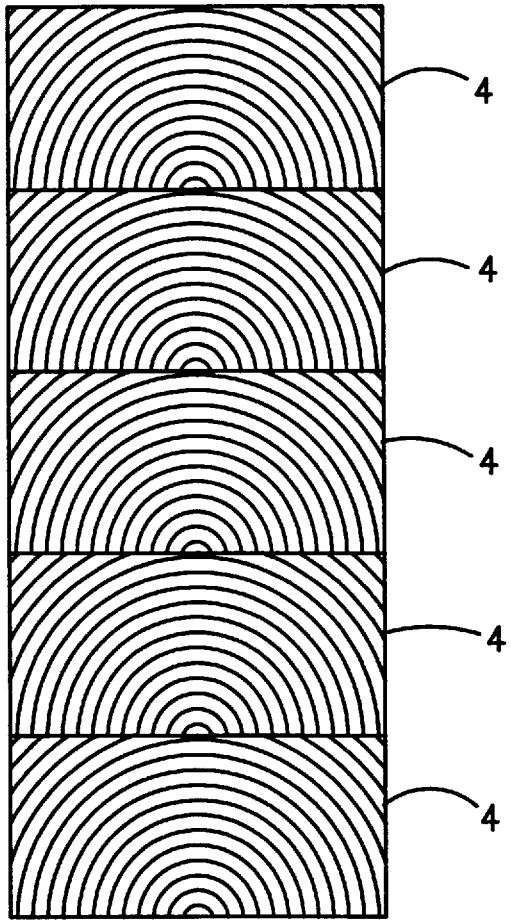
FIG. 3 (PRIOR ART)
FIG. 3 schematically shows a conventional beam composed of rectangular laminae.

In a conventional beam composed of rectangular laminae (FIG. 3), the aforementioned growth ring position is usually such that there are mainly horizontal growth rings; this leads to the fact that, depending on the content of horizontal growth rings, the swell-shrink behavior of the beam is unfavorable and the load capacity is limited.

Figure 4B:
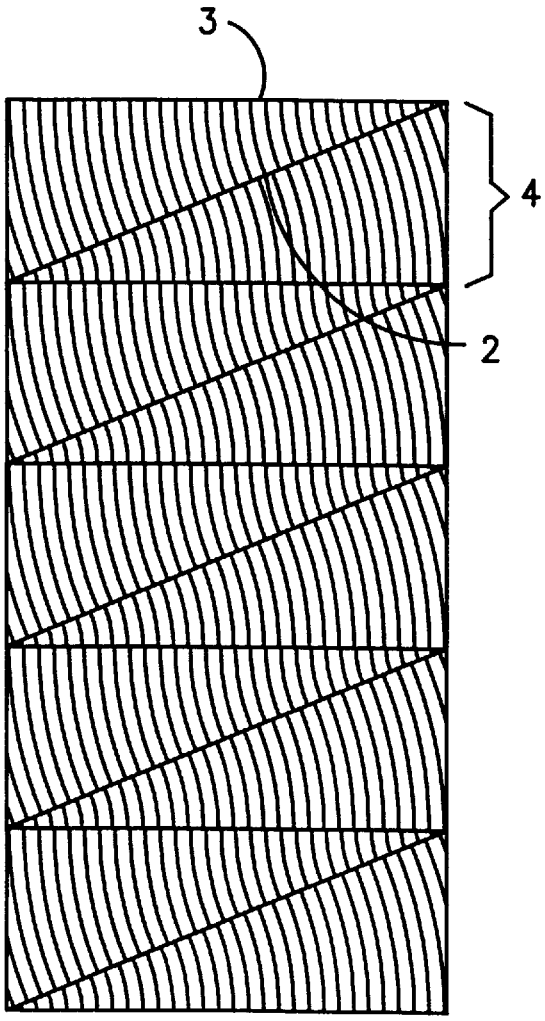

In the star mortise process (FIG. 2) used to produce the beam according to the invention, only sections 1 with vertical growth rings are produced. A beam assembled from these triangular sections 1 (FIG. 4B), in which the growth rings of each of the right triangular sections extends essentially vertically in a longitudinal direction of the beam, has a much more favorable swell/shrink behavior and can be loaded statically much more strongly than a comparable conventional beam.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. A beam comprising a plurality of rectanguloid laminae having short edges and wide faces, a wide face of each of the rectanguloid laminae being glued on top of a wide face of another, each of the rectanguloid lamimae being formed of two right triangular, radial tree trunk sections glued together with growth rings of each of the right triangular, radial tree trunk sections extending essentially vertically in a longitudinal direction of the beam and essentially perpendicular to the wide faces of all of the rectanguloid laminae.

2. A beam according to claim 1, wherein two longitudinal sides of the right triangular radial tree trunk sections are radially cut surfaces of the tree trunk from which they were produced.

3. Process of producing a beam comprising the steps of:

milling a tree trunk into a polygon;

producing right triangular, radial tree trunk sections from the milled tree trunk by a star mortise process;

drying and planing the radial tree trunk sections;

gluing pairs of right triangular, radial tree trunk sections to form rectanguloid laminae having short edges and wide faces; and gluing a wide face of each of the rectanguloid laminae on top of a wide face of another to form a beam in which growth rings of each of the right triangular tree trunk sections extends essentially vertically in a longitudinal direction of the beam.

4. A process according to claim 3, wherein the polygon into which tree trunk is milled is an octagon.

5. A beam produced by the process of claim 4.

6. A beam produced by the process of claim 3.

* * * * *